United States Patent [19]

Ward

[11] Patent Number: 4,512,463

[45] Date of Patent: Apr. 23, 1985

[54] FREE-STANDING FLEXIBLE CONTAINER FOR FLUIDS

[76] Inventor: Randall W. Ward, 5333 Baltimore Dr. #109, La Mesa, Calif. 92041

[21] Appl. No.: 576,445

[22] Filed: Feb. 2, 1984

[51] Int. Cl.[3] ..... B65D 77/04; B65D 83/00; B65B 39/00

[52] U.S. Cl. ..... 206/216; 206/223; 206/527; 220/461; 141/337; 383/104

[58] Field of Search ..... 206/216, 525, 527, 223; 220/462, 410, 408, 461, 72, 404, 463; 383/104, 906; 141/337

[56] References Cited

U.S. PATENT DOCUMENTS

| | | | |
|---|---|---|---|
| 3,027,044 | 3/1962 | Winstead | 220/72 |
| 3,029,008 | 4/1962 | Membrino | 220/462 |
| 3,065,895 | 11/1962 | Lipschutz et al. | 220/408 |
| 3,703,956 | 11/1972 | Oswalt | 206/223 |
| 4,064,302 | 12/1977 | Kozlowski et al. | 220/461 |
| 4,428,500 | 1/1984 | Kohler | 220/410 |

*Primary Examiner*—William T. Dixson, Jr.
*Attorney, Agent, or Firm*—Paul L. Hickman

[57] ABSTRACT

A container to receive draining fluids characterized by a flexible base and sidewall, and a relatively stiff annulus portion surrounding the base and attached to the sidewall to provide a receptacle. The annulus portion, with the sides and mouth of the container draped over and outside it, forms a free-standing perimeter of sufficient depth, diameter and stability to receive fluids being freely drained into it as from an automobile or tractor radiator, crankcase or transmission. When the draining is completed, the mouth of the container may be sealed to prevent leakage. A resealable, flexible tube is incorporated near the base of the container to serve as a drain spout.

5 Claims, 8 Drawing Figures

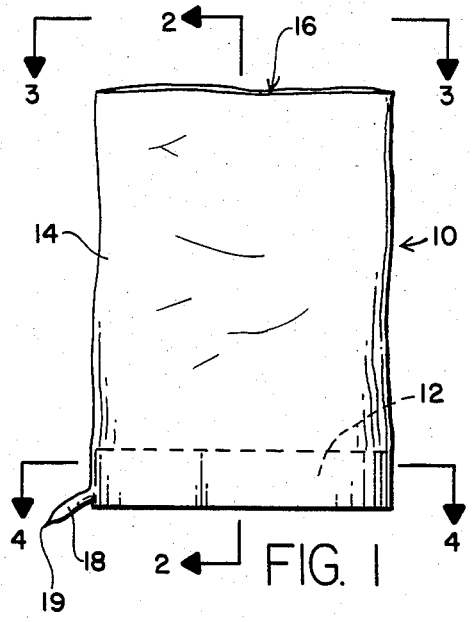
FIG. 1
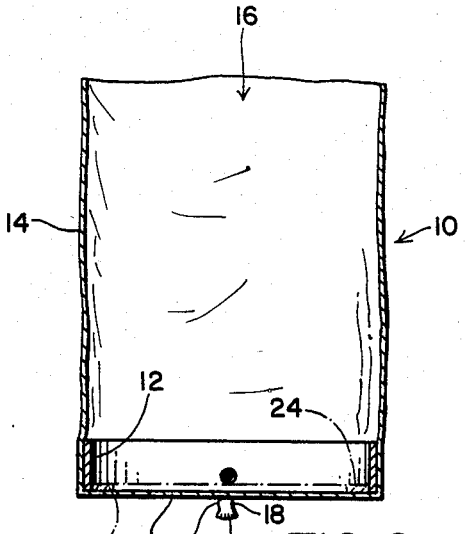
FIG. 2
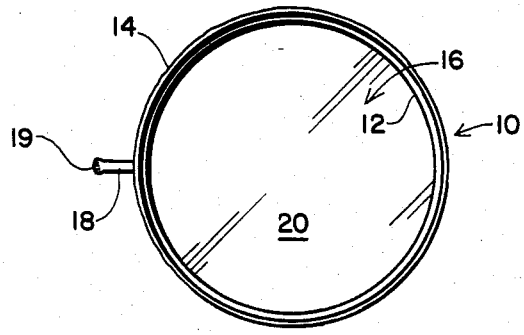
FIG. 3
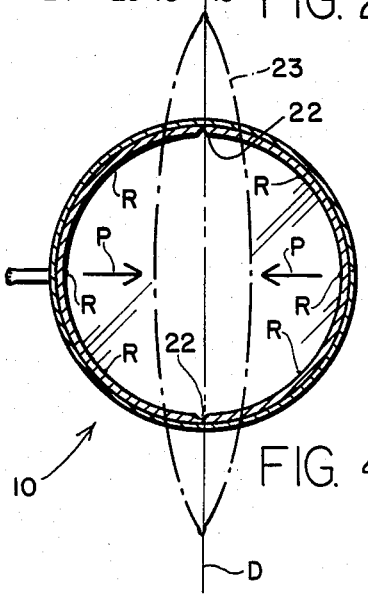
FIG. 4
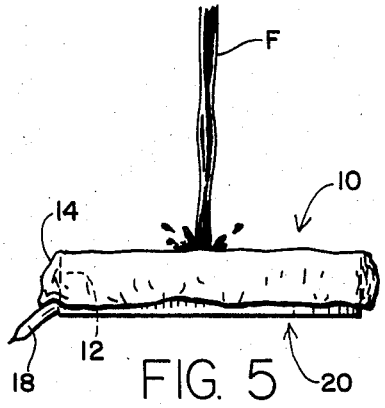
FIG. 5
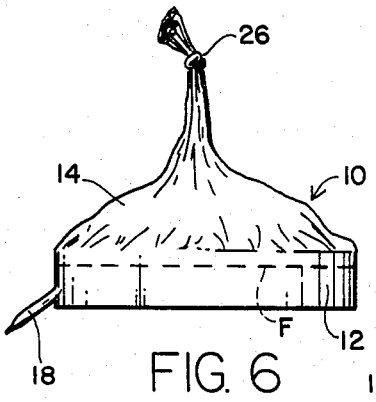
FIG. 6
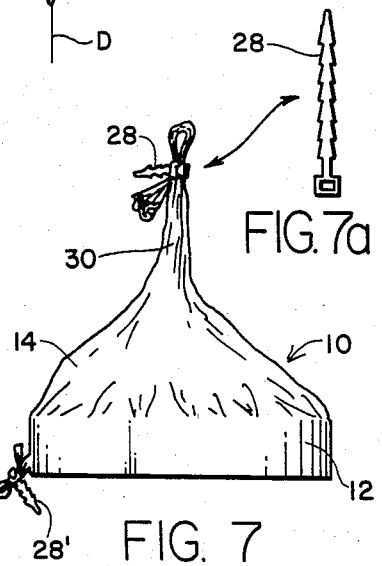
FIG. 7
FIG. 7a

FREE-STANDING FLEXIBLE CONTAINER FOR FLUIDS

BACKGROUND OF THE INVENTION

1. Field of the Invention

This invention relates generally to sealable containers, and more particularly to containers used to collect and discharge waste fluids.

2. Description of the Prior Art

An increasing number of people who traditionally utilized service stations and repair shops are today themselves draining and replacing fluids from their automobiles, outboard motors, farm equipment and other machinery. As almost universally performed, the fluid, e.g. motor oil or transmission fluid, is drained into a shallow metal or plastic pan. Often, the fluid is surreptitiously poured into the sewer system, onto the ground, transferred into milk cartons or other suitable containers for ultimate disposal in the garbage system.

Even though these methods of disposal are prohibited in most jurisdictions, it remains a fact that the percentage of lubricating or other fluids that reach recycle centers is minuscule. The absence of an inexpensive, simple and clean method of collecting, transporting and disposing of these fluids is responsible for a great deal of environmental pollution and waste of recyclable resources.

The capture of draining fluids has been previously addressed in the prior art. For example, in U.S. Pat. No. 4,098,398 a funnel or similar device is used to direct the flow of draining liquid into the collecting container. U.S. Pat. No. 3,703,956 avoids a restricted container mouth, incorporating in a kit a separate drain pan which provides shape and support to a wide-mouthed, liquid-tight bag for the collection of the fluids. U.S. Pat. No. 4,064,969 teaches two structures which hold the mouth of a flexible bag open and above the fluid level in the retaining portion of the bag.

SUMMARY OF THE INVENTION

It is a principal objective of the present invention to overcome several difficulties of the prior art by incorporating into a single flexible device features which provide for a more easily set up collection vessel of lower profile, improved stability during filling, a positive closure, a convenient means of dispensing the fluid collected, and an adaptability of the shape of the container to equipment requirements or irregularities of surface.

The aforesaid objective and its corollaries are accomplished by a sack-like container of thermoplastic or other material selected for its flexibility, strength and impermeability, provided with a relatively stiff annulus portion. The annulus portion provides a free-standing perimeter of sufficient depth, diameter and stability to receive fluids being drained into it. The flexibility of the base of the container and lesser flexibility of the annulus portion allow the container so formed to accommodate irregularities of surface or shape with little loss of stability.

After the fluid is drained into the container, the sidewall draped over and around the annulus portion can be raised, gathered together, and closed against leakage by tying a knot in it or by otherwise closing it off. The "neck" of sidewall material thus formed provides a convenient means for grasping and carrying the filled container.

A flexible drain spout made from tubular thermoplastic or other appropriate material is attached to the container at its lower sidewall or base to provide a means for dispensing the fluid contents in a controlled fashion, such as into the opening of a 55 gallon drum commonly used at a center for the collection of recyclable fluids.

An advantage of this invention is that oil and other waste fluids can be captured, transported, and disposed of in a convenient and sanitary manner.

These and other objects and advantages of the present invention will no doubt become apparent upon a reading of the following descriptions and a study of the several figures of the drawing.

BRIEF DESCRIPTION OF THE DRAWING

FIG. 1 is an elevational view of the preferred embodiment of the container in an artificially upright position to illustrate its major features.

FIG. 2 is a cross-sectional view taken along line 2—2 of FIG. 1.

FIG. 3 is a top plan view taken along line 3—3 of FIG. 1.

FIG. 4 is a cross sectional view taken along line 4—4 of FIG. 1.

FIG. 5 is an elevational view illustrating the container receiving waste fluids.

FIG. 6 illustrates one method for sealing the top of the container.

FIG. 7 illustrates alternate methods for sealing the top of the container and the drain spout of the container.

FIG. 7*a* is a detail view of one type of closure device which can be used with the present invention.

DETAILED DESCRIPTION OF THE PREFERRED EMBODIMENT(S)

Referring to FIGS. 1, 2, and 3, a flexible free-standing container 10 is shown in an artificially upright position and includes an annulus portion 12 around the base of the sidewall 14. An open mouth 16 is provided at the top of sidewall 14. A drain spout 18 for the controlled discharge of the fluid contents of container 10 is shown at its preferred location in the lower sidewall of the container. The base 20 of the container is preferably of about the same in flexibility as the sidewall so that it may conform to the surface upon which it rests.

The container 10 is made from a flexible material, impervious to the hot motor oil or other drained fluids for which it is marketed, resistant to accidental penetration by blunt objects, and capable of supporting the weight of its intended contents when it is suspended by sidewall 14. Those skilled in the art can use any number of thermoplastic materials to meet the above identified design criteria. However, other materials may be used exclusively or in combination with thermoplastics as their advantages become evident.

Annulus portion 12, which could alternately be described as a hoop formed from a continuous strip of material, may be either formed as a thickened part of sidewall 14 and/or base 20, or may be manufactured separately and then attached to the sidewall and base. Similarly, the sidewall and base could be constructed integrally in the form of a bag or sack, or could alternatively be made separately and assembled together in a subsequent manufacturing step.

For example, the container may be formed by inserting and attaching an annular portion between the sidewall 14 and base 20 of the container by any one or combination of techniques including adhesives, heat sealing, lamination, etc. The above fabrication alternatives are intended to be illustrative of means for providing a less flexible wall segment around the base of the container, where its height and diameter determines the capacity of the container in its filling configuration.

The annulus portion 12 and base 20 comprise a receptacle into which waste fluids can be drained. The sidewall 14 serves to seal the top of the container, and provide a convenient method for carrying the container. A typical container of the present invention would have an annular portion about 4 inches in height and 14 inches in diameter, providing a free-standing receptacle of approximately 10 US quart capacity.

Annulus portion 12 is substantially circular in lateral cross-section, but can also be made in other configurations. For example, square, oblong, rectangular, and elliptical annular portions are embodiments of this invention which may be more suited for particular terrains or machinery requirements. Furthermore, the annulus portion, if sufficiently flexible, can be deformed by hand into oblong, eliptical shapes to adapt to particular terrains or machinery requirements.

Referring to the cross-sectional view of FIG. 4, the annulus portion 12 may be provided with at least two relieved portions 22 where the material of the annulus portion has been crimped, deformed, removed, or omitted to provide a live hinge. To operate properly as a hinge, the relieved areas should be diametrically opposed as illustrated by diametric axis D.

When inward, radial pressure is applied to annulus portion 12 as suggested by the arrows labeled "P", the annulus portion can collapse into a substantially flat configuration 23 for shipping and storage. Of course, outward radial pressure will urge the annular portion into its normal circular configuration. A number of other relief points "R" may be provided to further aid in the folding of the annulus portion.

The sidewall 14 may be somewhat larger in circumference and diameter than the annulus portion 12 to enable it to be pulled over and around the ring providing it additional support in the filling configuration. The sidewall 14 of this preferred embodiment is preferably tubular in shape, and should be tall enough so that it may be tied off in some fashion so that the container may be sealed.

As illustrated in broken lines in FIG. 2, a flange 24 of the annulus portion 12 can extend concentrically inwardly along base 20 to stiffen and support the base. To the extent that flange 24 extends inwardly from the circumference, the base 20 becomes more rigid. With the entire base thus stiffened a more clearly defined shallow pan or vessel is created with increased rigidity and lacking the flexibility of the preferred embodiment. The resulting alternate embodiment is a container of flexible upper sidewall only, extending from the rim of a semi-rigid or rigid shallow vessel. A plurality of such containers could be packaged for marketing in a "nested" configuration.

The drain spout 18 is preferably made from a flexible tube and provides a means for conveniently discharging the fluid contents of the container. Locating the tube so that it communicates with the interior at the annulus portion 12 maximizes user convenience, however its location is not critical. The spout may be an integral part of the container wall or it may be bonded to the container by adhesive, heat sealing or other techniques. While neither its length nor diameter is critical, a length of five inches and diameter $\frac{5}{8}$ of an inch would appear convenient for discharging 6 to 8 quarts of fluid the viscosity of motor oil into, for example the threaded opening in a 55-gallon drum or returning engine coolant to a radiator. During discharge of the contents simple finger manipulation may varyingly restrict and direct the flow of liquids through the spout.

As illustrated, the preferred embodiment has the end 19 of the spout 18 sealed at manufacture. To discharge the contents of container 10, the end 19 is simply pierced or cut off. Restrictive finger pressure is used to direct and control the flow of fluid by manipulating the tube. In the event re-use is desired the tube may be closed by knotting it, or by folding it over against itself and constricting it with any one of several closing ties commercially available.

FIG. 5 shows the container 10 in plan view with the upper sidewall 14 pulled down over and draped around outside the annulus portion 12 providing it additional support and exposing the entire approximately circular base 20 to the fluid draining into it. A fluid "F", such as engine oil, is then drained into the receptacle defined by annular portion 12 and base 20.

FIG. 6 depicts the container filled to below the height of the annulus portion 12 with fluid F, and with the sidewall 14 raised, gathered together toward the top of the container and knotted 26 with a simple overhand knot to prevent leakage through the mouth of the container.

FIG. 7 depicts the sidewall 14 of the container 10 at the mouth folded over against itself and closed with one example of the several closing ties 28 currently commercially available. The neck 30 of the closed sidewall material, as may be seen, provides a convenient means for grasping and carrying the filled container. Similarly, the drain spout 18 (after being opened as described above) can be sealed by folding it over against itself and closed with a closing tie 28'.

It can be seen from the foregoing description that an inexpensive and disposable container allowing compact marketing configurations and the clean and convenient capture, containment and disposal of drained fluids has been provided. While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A container comprising:

(a) an annulus portion including a band of material formed into a squat annuluar wall, said band of material being sufficiently rigid to allow said annular wall to be freestanding, said annulus portion having an inner surface and an outer surface;

(b) a base portion which is relatively more flexible than said band of material, said base portion closing the bottom of said annulus portion;

(c) a tubular sidewall portion which is also relatively more flexible than said band of material, said tubular sidewall portion being upwardly extensible from said annulus portion and having a sealable mouth such that said annulus portion, said base portion, and said tubular sidewall portion cooperate to form a fluid-tight container when said mouth is sealed, said base portion and said tubular sidewall portion being of unitary construction and of substantially uniform thickness, wherein said base portion is substantially planar and wherein said sidewall portion joins said base portion at substantially right angles relative thereto, where said annulus portion is attached to said sidewall portion proximate its juncture to said base portion such that only one of said inner surface and said outer surface is in contact with said sidewall portion; and (d) a drain spout extending from and made contiguous with said annulus portion, said drain spout being operative to drain fluids contained within said container.

2. A container as recited in claim 1 wherein said annulus portion further includes a radially inwardly extending section along a lower edge thereof which strengthens at least a part of said relatively flexible base portion.

3. A container as recited in claim 1 wherein said band of material is provided with at least two, opposing relieved sections such that said band of material can be collapsed to a substantially flat configuration.

4. A container comprising:

(a) an annulus including a band of material formed into a squat annulus wall, said band of material being sufficiently rigid to allow said annular wall to be freestanding, said annulus including a radially inwardly extending flange along a lower edge thereof which strengthens at least a part of said relatively flexible base portion;

(b) a base portion which is relatively more flexible than said band of material, said base portion closing the bottom of said annulus;

(c) a tubular sidewall portion which is also relatively more flexible than said band of material, said tubular sidewall portion being upwardly extensible from said annulus and having a sealable mouth such that said annulus, said base portion, and said tubular sidewall portion cooperate to form a fluid-tight container when said mouth is sealed; and (d) a drain spout extending from said annulus, said drain spout being operative to drain fluids contained within said container.

5. A container comprising:

(a) an annulus including a band of material formed into a squat annular wall, said band of material being sufficiently rigid to allow said annular wall to be freestanding, said band of material being provided with at least two, opposing relieved sections such that said band of material can be collapsed to a substantially flat configuration;

(b) a base portion which is relatively more flexible than said band of material, said base portion closing the bottom of said annulus;

(c) a tubular sidewall portion which is also relatively more flexible than said band of material, said tubular sidewall portion being upwardly extensible from said annulus and having a sealable mouth such that said annulus, said base portion, and said tubular sidewall portion cooperate to form a fluid-tight container when said mouth is sealed; and (d) a drain spout extending from said annulus, said drain spout being operative to drain fluids contained within said container.

* * * * *